US007975683B1

(12) United States Patent
Williams et al.

(10) Patent No.: US 7,975,683 B1
(45) Date of Patent: Jul. 12, 2011

(54) SPRING ACTION PAINTBALL MARKER

(75) Inventors: Steve Williams, Lowell, AR (US); Cole Krebs, Tega Cay, SC (US); Ho Bun Choi, Hong Kong (CN)

(73) Assignee: Kee Action Sports, LLC, Sewell, NJ (US)

( * ) Notice: Subject to any disclaimer, the term of this patent is extended or adjusted under 35 U.S.C. 154(b) by 0 days.

(21) Appl. No.: 12/655,359

(22) Filed: Dec. 29, 2009

Related U.S. Application Data

(60) Provisional application No. 61/203,755, filed on Dec. 29, 2008.

(51) Int. Cl.
*F41B 11/00* (2006.01)

(52) U.S. Cl. ..... 124/67

(58) Field of Classification Search ..... 124/65–68
See application file for complete search history.

(56) References Cited

U.S. PATENT DOCUMENTS

| | | | | | |
|---|---|---|---|---|---|
| 3,766,903 | A | * | 10/1973 | Fischer | 124/67 |
| 3,908,626 | A | * | 9/1975 | Hammond | 124/67 |
| 3,951,038 | A | * | 4/1976 | Van Langenhoven | 89/7 |
| 4,002,156 | A | * | 1/1977 | Fischer | 124/67 |
| 4,367,723 | A | | 1/1983 | Resuggan | 124/67 |
| 4,771,758 | A | * | 9/1988 | Taylor et al. | 124/68 |
| 4,883,042 | A | * | 11/1989 | Wackrow | 124/67 |
| 5,133,331 | A | * | 7/1992 | Hutchinson | 124/68 |
| 5,349,939 | A | | 9/1994 | Perrone | 124/76 |
| 5,775,312 | A | | 7/1998 | Wilkinson et al. | 124/67 |

* cited by examiner

*Primary Examiner* — Troy Chambers
(74) *Attorney, Agent, or Firm* — Keisling & Pieper PLC; David B. Pieper

(57) ABSTRACT

A paintball marker using a piston and compression spring mounted in an air focus tube for generating compressed air for launching a paintball down a barrel. A trigger and sear are used to catch the compression spring when it is compressed to control the launching of the paintball. Exterior pull handles mounted behind the marker, and slideably mounted on the barrel are described for compressing the spring. Also, a pivotally mounted barrel is provided as another embodiment for compressing the spring.

3 Claims, 4 Drawing Sheets

100
110
112
114
116
118
120
122
124
126
128
130
132
134
136
138
140
142
144
146
148
150
160
170
180
190
200
210
212
214
216
218
220
222
230
240
250
260
280
290
300

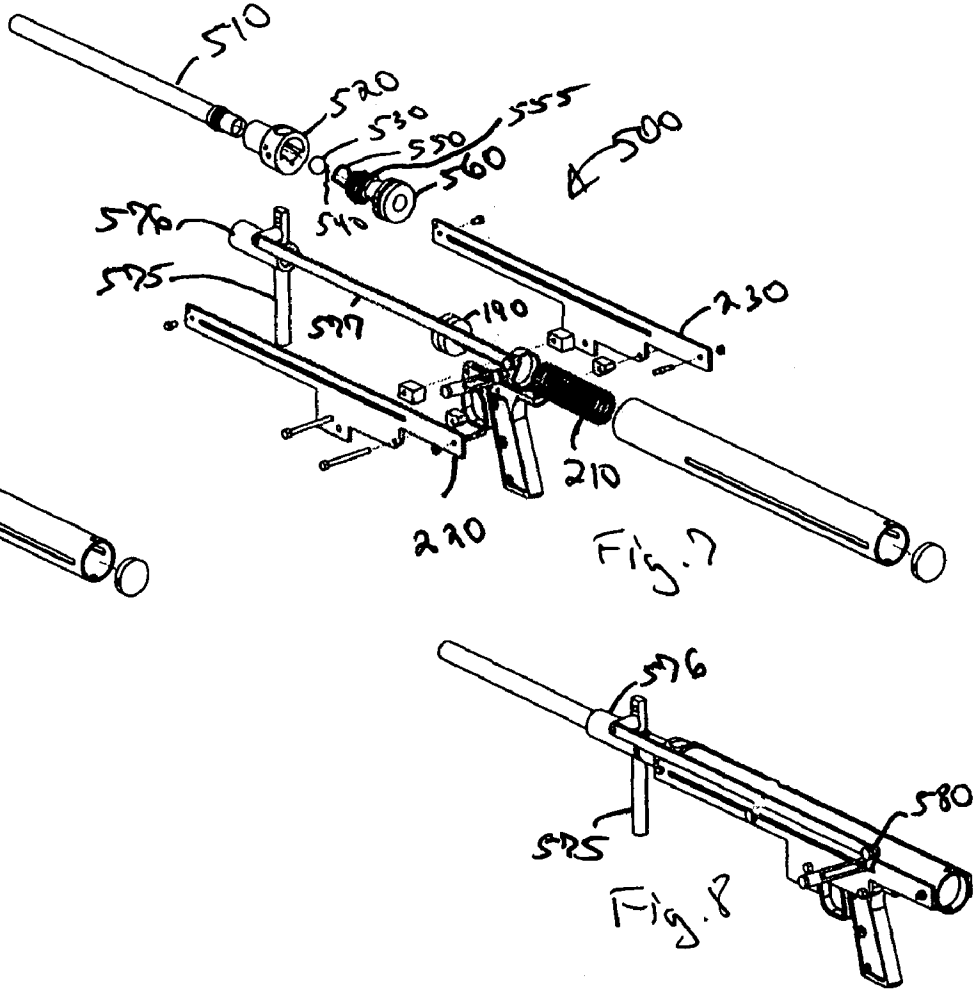
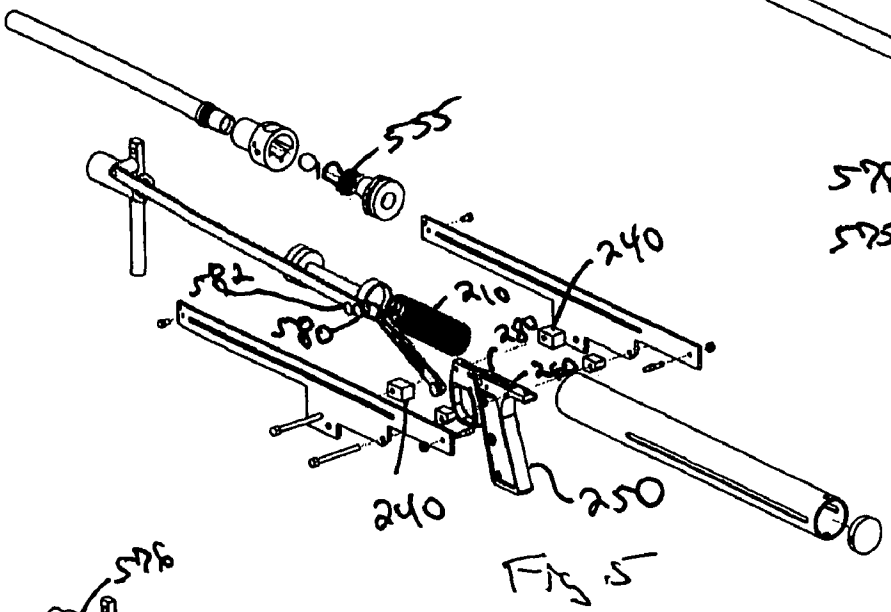
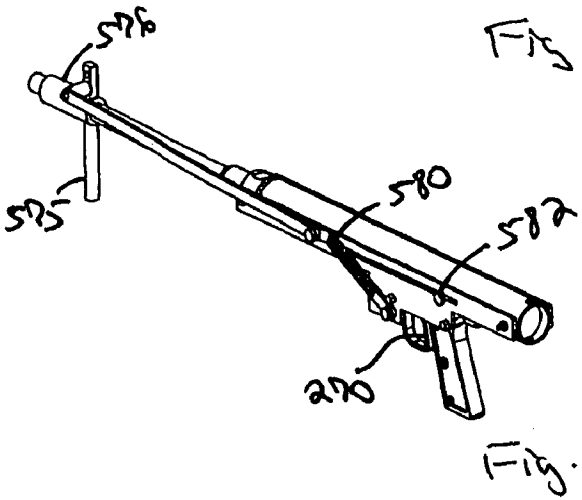

SPRING ACTION PAINTBALL MARKER

CROSS-REFERENCE TO RELATED APPLICATIONS

This application is a continuation-in-part of U.S. Patent Application 61/203,755 filed on Dec. 29, 2008 for inventor Steve Williams entitled SPRING ACTION PAINTBALL MARKER.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in paintball markers used to launch paintballs. More particularly, the invention relates to improvements particularly suited for remote operation of paintball markers away from a compressed gas bottle or other source. In particular, the present invention relates specifically to a compressed spring operated paintball marker with a compression mechanism.

2. Description of the Known Art

As will be appreciated by those skilled in the art, the basic construction for a paintball marker has always used a compressed gas source controlled through a valve to release pressure to launch a paintball. An illustrative patents disclosing information relevant to this construction is U.S. Pat. No. 5,349,939, issued to Perrone on Sep. 27, 1994 entitled Semi-Automatic Gun. Conversely, BB guns or air pellet guns have used spring compression mechanisms for generating the firing pressures. Illustrative patents include U.S. Pat. No. 5,775,312, issued to Wilkenson, et al. on Jul. 7, 1988 entitled Spring Air Gun with Interlocking Mechanism; and U.S. Pat. No. 4,367,723, issued to Resuggan, on Jan. 11, 1983, entitled Air Gun with Piston Fully Cocked in Plurality of Stages. All of these patents are hereby expressly incorporated by reference in their entirety. It is believed that the boundaries of these different technologies has never been crossed to allow for a paintball to be launched using compressed air generated within a paintball marker by spring released energy driving a compression piston. From these prior references it may be seen that these prior art patents are very limited in their teaching and utilization, and an improved paintball marker is needed to overcome these limitations.

SUMMARY OF THE INVENTION

The present invention is directed to an improved paintball marker using a compression mechanism operated by the user to compress a spring that moves a piston to generate the compressed air for launching a paintball. In accordance with one exemplary embodiment of the present invention, the compression mechanism is a pull handle using a forced air tube and piston for generating the compressed air. Another embodiment uses a compression handle sliding on a barrel guide. A still further embodiment uses a pivoting handle frame. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 5 is an exploded view of a sliding handle spring powered marker before compression.

FIG. 6 is an assembled view of a sliding handle spring powered marker before compression.

FIG. 7 is an exploded view of a sliding handle spring powered marker after compression.

FIG. 8 is an assembled view of a sliding handle spring powered marker after compression.

FIG. 13 shows a motor driven rack and pinion for spring compression in the uncompressed position.

DETAILED DESCRIPTION OF THE INVENTION

Figures 1, 2, 3, 4:
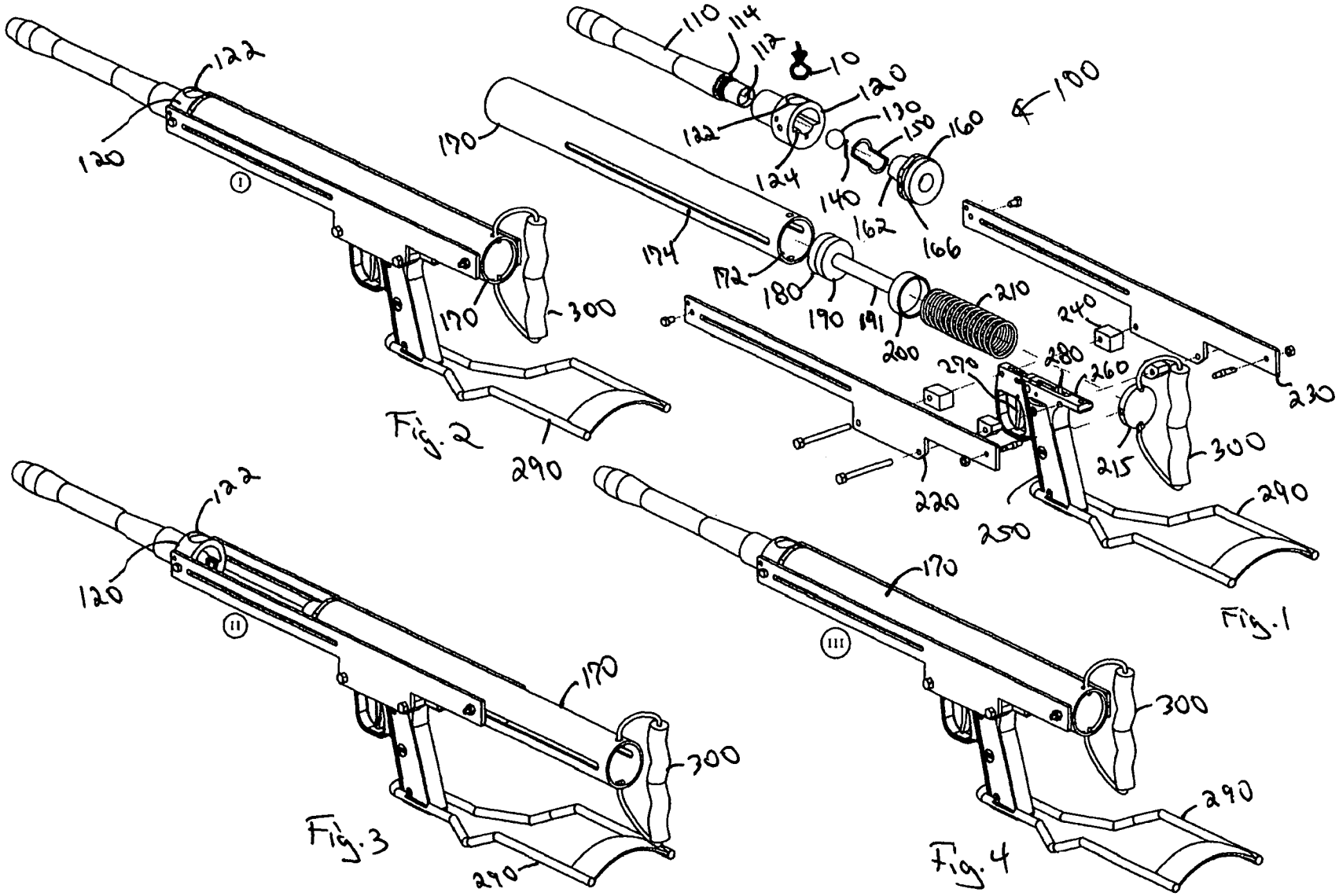
FIG. 1 is an exploded view of a pull handle spring powered marker.
FIG. 2 is an isometric view of a pull handle spring powered marker before compression.
FIG. 3 is an isometric view of a pull handle spring powered marker after compression.
FIG. 4 is an isometric view of a pull handle spring powered marker that is ready to fire.

As shown in FIG. 1 of the drawings, one exemplary embodiment of the present invention is generally shown as a pull handle spring powered marker 100 for launching a paintball 10. Starting at the front of the marker 100, a conventional barrel 110 with inner bore 112 and exterior threads 114 is threadably screwed into mating threads in a ball chamber 120. The ball chamber 120 defines an input port 122 for receiving a paintball 10 passably connected to a breech 124 for holding the ball 10 for firing. The breach 124 holds an o-ring ring seal 130 to seal to the impact ring 160 during firing. Additionally, the breach 124 includes a ball retention pin 140 and ball cradle 150 to hold the ball 10 in position after loading and before firing. Both the pin 140 and the ball cradle 150 apply only slight pressure to the paintball 10 so as to hold, but not rupture the ball 10. The impact ring 160 includes a male extension 162 designed to fit into the ball chamber 120 to load the paintball 10 into the firing position and seal off the input port 122 so that compressed air is directed through the center bore 164 of the impact ring 160, through the breach 124, and down the inner bore 112 of the barrel 100 to launch the paintball 10. Thus, the impact ring 160 moves in relation to the ball chamber 120 to load the paintball 10 into the breach 124 and seal off the input port 122 and then moves back to unseal the breach 124 and open the input port 122 for the next paintball 10. The impact ring 160 includes an external seal 166 to seal to the inside diameter 172 air focus tube 170.

The air focus tube 170 works in cooperation with the impact ring 160 and the piston 190 to generate a compressed air source that is delivered through the hollow impact ring 160 to drive the paintball 10 down the barrel 100. The piston 190 includes a piston seal 180 to slideably seal to the inside diameter 172 of the air focus tube 170 to generate the compressed air. Air at atmospheric pressure enters the air focus tube 170 through the open slot sides 174 when the piston is pulled back and away from the impact ring 160. The piston 190 includes a spring seat 200 so that the backward movement of the piston 190 compresses the compression spring 210. The compression spring 210 is compressed between the spring seat 200 and the end cap 215. The end cap 215 is connected in a fixed position though the open slot sides 174 of the air focus tube 170 to the side guides 220, 230. The left side guide 220 and right side guide 230 are connected using spacers 240 to the trigger grip 250 to provide a base platform for the spring compression. The open slots in the guides 220, 230 allows for controlled movement of the impact ring 160 during spring compression and release. The trigger grip 250 includes a standard paintball gun type of mechanism using a grip frame 260 for pivotally mounting a spring biased trigger 270 and sear 280 as is well known in the art. An arm brace 290 is included for additional support during cocking and firing of the paintball marker 100. Force on the spring is supplied by the user holding the grip frame 260 and pulling on the pull handle 300.

Because the pull handle 300 is connected to the air focus tube 170 and the air focus tube is connected to the impact ring 160, the impact ring 160 is pulled back wards in relation to the guides 220, 230. The piston 190, connecting shaft 191, and spring seat 200 and the compression spring 210 are trapped between the impact ring 160 and the end cap 215. In this manner, the compression spring 210 is compressed and the piston 190 is pulled backwards until the front of the spring seat 200 moves behind the sear 280. In this manner, the front of the spring seat 200 engages the sear 280 and the spring 210 is held in a compressed state to ready the paintball marker for firing. The pull handle 300 is then moved forward to move the air focus tube 170 and the impact ring 160 forward to load the paintball into the breach and seal off the input port. Air at atmospheric pressure now enters the area in front of the piston. When movement of the sear 280 by the trigger releases the energy of the compressed spring 210, the piston moves forward past the side slots of the air focus tube to seal off the front portion of the air focus tube. Continued forward movement compresses the air and this compressed air travels through the impact ring and the breach to launch the paintball out of the barrel. FIGS. 2 through 4 show the operation of the components to fire a paintball. In FIG. 2, the marker 100 is shown before cocking with the air focus tube 170 in the forward position. In FIG. 3, the air focus tube has been pulled back to compress the spring and engage the sear with the piston to retain the energy in the spring. In FIG. 4, the air focus tube has been returned forward to create the compression chamber so that the spring can be released to generate the compressed air for firing the paintball.

FIGS. 5 through 8 show the sliding barrel handle compression device paintball marker 500. In this embodiment a smooth exterior barrel 510 is used for controlling the compression of the spring. The barrel 510 connected to the ball chamber 520 and uses an o-ring ring seal 530, pin 540, and ball cradle 550 similar to the previous embodiment. Once again, an impact ring 560, and air focus tube 570 are used, but the air focus tube 570 is fixed in position and the impact ring is slideably mounted in the tube 570 with a rear bias spring 555 is provided to bias the impact ring 560 backwards inside the tube 570. This allows for the paintball to be loaded, and impact of the piston drives the impact ring 560 forward to seal of the input and release the compressed air. A front handle 575 and barrel slide 576 are provided for the driving force for the piston 190. The front handle 575 and barrel slide 576 are connected to a drive arm 577 that has an engaging stem 580 to engage a drive pin 582 extending off of the piston 190. The backwards movement of the front handle 575 moves the engaging stem 580 which engages the drive pin 582 which moves the piston 190 and compresses the spring 210. The piston 190 and spring 210 are again trapped by a sear 280 to remain in the compressed state until the trigger 270 is pulled. A similar construction to the previous embodiment is then used on the remainder of the marker including a left side guide 220, right side guide 230, spacers 240, and trigger grip 250 with grip frame 260, trigger 270, and sear 280.

Figures 9, 10, 11, 12:
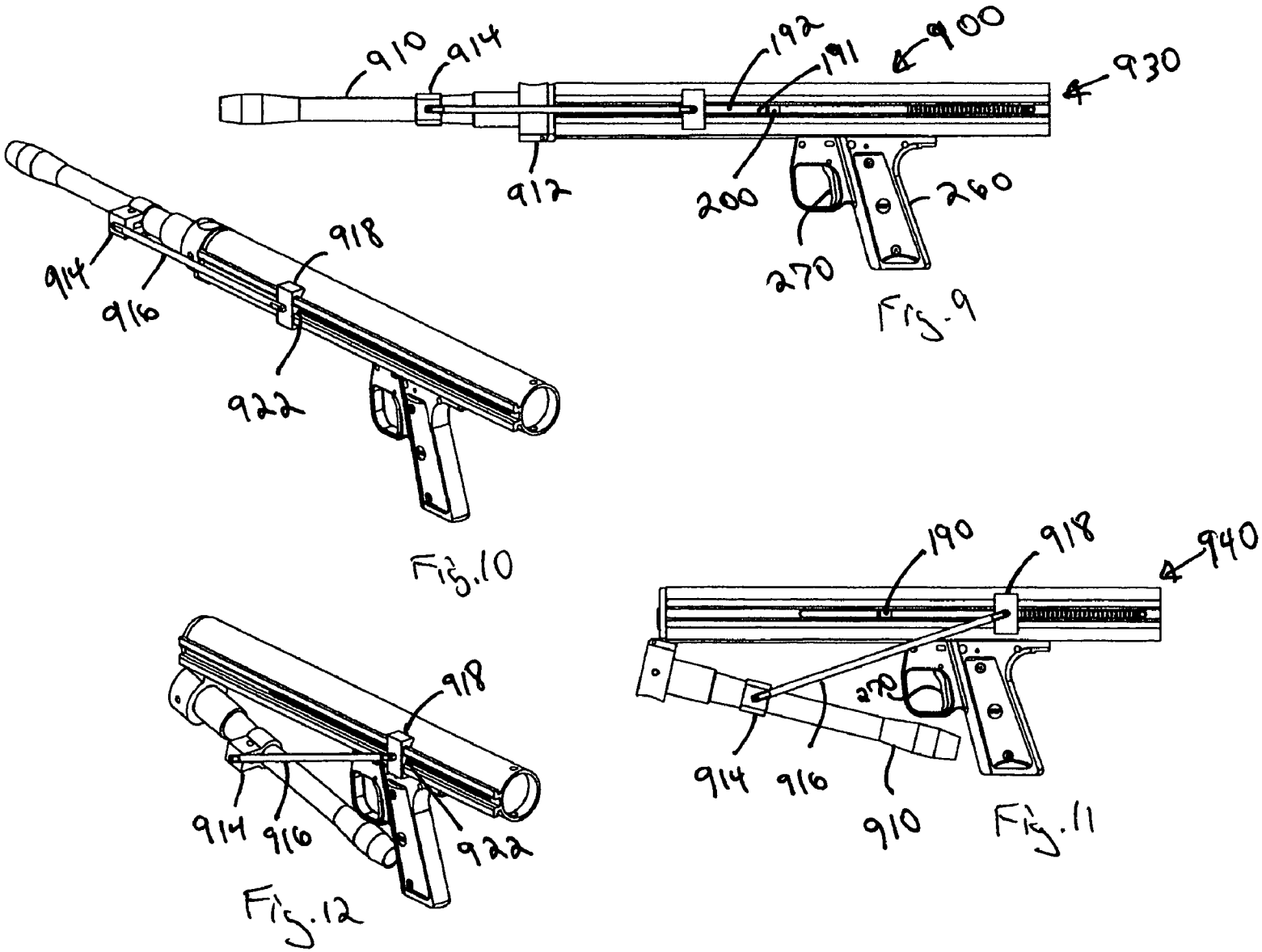
FIG. 9 is a side view of a pivot barrel spring powered marker before compression.
FIG. 10 is an isometric view of a pivot barrel spring powered marker before compression.
FIG. 11 is a side view of a pivot barrel spring powered marker after compression.
FIG. 12 is an isometric view of a pivot barrel spring powered marker after compression.

FIGS. 9 through 12 show the embodiment of a hinged barrel level marker 900 where the barrel 910 is mounted with a barrel pivot 912 off the grip frame 260. The barrel 910 supports an arm pivot 914 that is pivotally engaged with a push arm 916. The push arm 916 is connected to a side pivot slide block 918 that rides on slide rails 920 connected to the side of the air focus tube 570. The side pivot slide block 918 has an inwardly directed pin 922 that engages the shaft aperture 192 associated with the axial connecting shaft 191 located between the piston 190 and the spring seat 200. This allows the inwardly directed pin 922 to engage the front of the spring seat 200 and move it backwards to compress the spring 210. As in the previous embodiment, the piston 190 and spring 210 are again trapped by a sear 280 to remain in the compressed state until the trigger 270 is pulled. The barrel 910 is pivoted back to the firing position which moves the push arm 916 forward which moves the side pivot slide block 918 forward in the shaft aperture 912 to allow the spring to move the piston forward and compress air to fire the paintball. FIG. 9 shows the firing position 930 and FIG. 11 shows the cocking position 940.

Figures 14, 15:
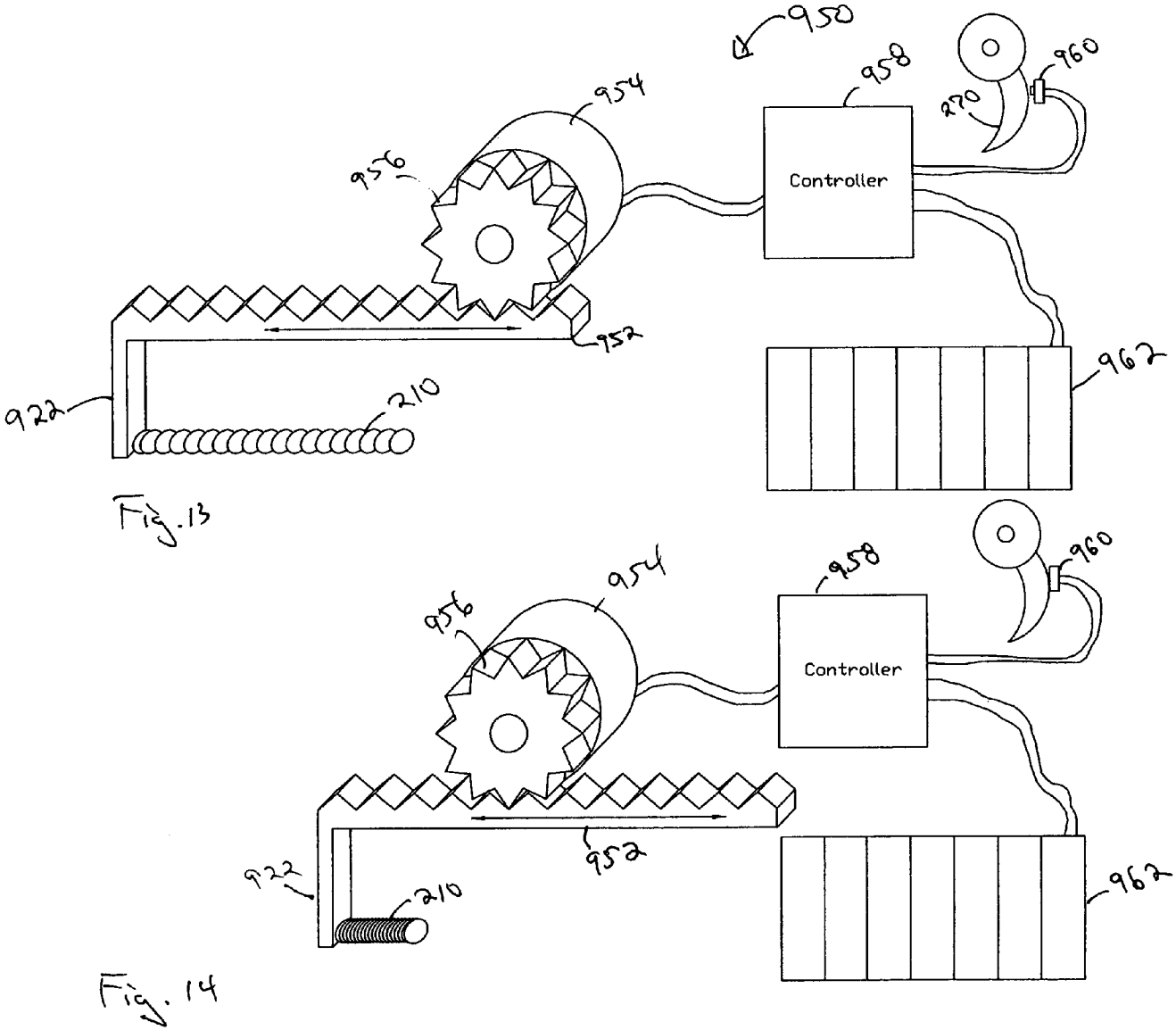
FIG. 14 shows the motor driven rack in the compressed position.

FIGS. 13 and 14 show a motor drive 950 for moving the inwardly directed pin 922. A rack 952 is connected to the inwardly directed pin 922. A motor 954 with driven pinion 956 is engaged with the rack 952 to move the inwardly directed pin 922 to compress the spring 210. The motor 924 is controlled by a controller circuit 958 which uses a sensor 960 to sense movement of the trigger 270. Power for the controller circuit 958 and motor 954 are provided by the battery 962. FIG. 14 shows how pivoted movement of the trigger 270 operates the sensor 960 to tell the controller 958 to drive the motor 954 and move the pinion 956 to move the rack 952 and inwardly directed pin 922 to compress the spring 210.

Reference numerals used throughout the detailed description and the drawings correspond to the following elements:

pull handle spring powered marker 100
paintball 10
conventional barrel 110
inner bore 112
exterior threads 114
ball chamber 120 input port 122
breech 124
o-ring ring seal 130
ball retention pin 140
ball cradle 150
impact ring 160
male extension 162
center bore 164
external seal 166
air focus tube 170
inside diameter 172
open slot sides 174
piston seal 180
piston 190
connecting shaft 191
shaft aperture 192
spring seat 200
compression spring 210
end cap 215
left side guide 220
left guide slot 222
right side guide 230
right guide slot 232
spacers 240
trigger grip 250
grip frame 260
spring biased trigger 270
sear 280
arm brace 290
pull handle 300
Sliding handle paintball marker 500
smooth exterior barrel 510
ball chamber 520
an o-ring ring seal 530
pin 540
ball cradle 550
rear bias spring 555
impact ring 560
air focus tube 570
front handle 575
barrel slide 576
drive arm 577
engaging stem 580
drive pin 582
hinged barrel lever marker 900
barrel 910
barrel pivot 912
arm pivot 914
push arm 916
side pivot slide block 918
slide rails 920
inwardly directed pin 922
firing position 930
cocking position 940

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A paintball marker apparatus for launching a paintball, the apparatus comprising:
- a barrel;
- an input port;
- a breach flowably connecting the input port to the barrel;
- an air focus tube;
- an impact ring connected to the air focus tube and flowably connecting the air focus tube to the breach, the impact ring moveably positioned in the breach to selectively seal the input port;
- a piston moveably positioned in the air focus tube;
- a spring seat connected to the piston, the spring seat also positioned in the air focus tube;
- a compression spring contacting the spring seat, the compression spring also positioned in the air focus tube;
- an end cap positioned in the air focus tube to hold the compression spring in the air focus tube;
- at least one guide slideably connected to the air focus tube, the end cap connected to the at least one guide;
- a trigger grip with a sear connected to the at least one guide, the sear selectively engaging the spring seat; and
- a pull handle connected to the air focus tube.

2. A paintball marker apparatus for launching a paintball, the apparatus comprising:
- a barrel;
- an input port;
- a breach flowably connecting the input port to the barrel;
- an air focus tube;
- a rearwardly biased impact ring moveably positioned in the air focus tube and flowably connecting the air focus tube to the breach, the impact ring moveably positioned in the breach to selectively seal the input port;
- a piston moveably positioned in the air focus tube;
- a drive pin connected to the piston;
- a spring seat connected to the piston, the spring seat also positioned in the air focus tube;
- a compression spring contacting the spring seat, the compression spring also positioned in the air focus tube;
- an end cap connected to the air focus tube to hold the compression spring in the air focus tube;
- at least one guide connected to the air focus tube;
- a trigger grip with a sear connected to the at least one guide, the sear selectively engaging the spring seat;
- a barrel slide slidably mounted on the barrel;
- a front handle connected to the barrel slide;
- a drive arm connected to the barrel slide; and
- and engaging stem connected to the drive arm for engaging the drive pin.

3. A paintball marker apparatus for launching a paintball, the apparatus comprising:

a barrel;

an input port;

a breach flowably connecting the input port to the barrel;

an air focus tube;

a rearwardly biased impact ring moveably positioned in the air focus tube and flowably connecting the air focus tube to the breach, the impact ring moveably positioned in the breach to selectively seal the input port;

a piston moveably positioned in the air focus tube;

a drive pin connected to the piston;

a spring seat connected to the piston, the spring seat also positioned in the air focus tube;

a compression spring contacting the spring seat, the compression spring also positioned in the air focus tube;

an end cap connected to the air focus tube to hold the compression spring in the air focus tube;

a trigger grip with a sear connected to the air focus tube, the sear selectively engaging the spring seat;

at least one slide connected to the air focus tube;

a barrel pivot connected to the air focus tube;

the barrel connected to the barrel pivot so that the barrel is pivotally connected to the air focus tube between a firing position and a cocking position;

a push arm pivotally connected to the barrel;

a side pivot slide block slideably mounted to the at least one slide and pivotally mounted to the push arm; and an inwardly directed pin connected to the side pivot slide block, the inwardly directed pin selectively engaging the spring seat when the barrel is pivoted to the cocking position.

* * * * *